US011173993B2

(12) United States Patent
Duclos et al.

(10) Patent No.: US 11,173,993 B2
(45) Date of Patent: Nov. 16, 2021

(54) BOAT COMPRISING ENGINES THAT HAVE PROPELLERS EACH POSITIONED IN A DUCT, ENSURING OPTIMISED OPERATION DURING FORWARD TRAVEL AND HIGH MANOEUVRABILITY

(71) Applicant: PINBALL BOAT, La Teste de Buch (FR)

(72) Inventors: Pascal Eric Duclos, Arcachon (FR); Stéphane Julien Chaurial, Biganos (FR); Simon Rigaud, Orsay (FR)

(73) Assignee: PINBALL BOAT, La Teste de Buch (FR)

( * ) Notice: Subject to any disclaimer, the term of this patent is extended or adjusted under 35 U.S.C. 154(b) by 0 days.

(21) Appl. No.: 16/768,219

(22) PCT Filed: Nov. 28, 2018

(86) PCT No.: PCT/EP2018/082905
§ 371 (c)(1),
(2) Date: May 29, 2020

(87) PCT Pub. No.: WO2019/106053
PCT Pub. Date: Jun. 6, 2019

(65) Prior Publication Data

US 2020/0290712 A1 Sep. 17, 2020

(30) Foreign Application Priority Data

Nov. 29, 2017 (FR) ..... 1761344

(51) Int. Cl.
*B63H 11/08* (2006.01)
*B63B 1/04* (2006.01)
*B63H 11/00* (2006.01)

(52) U.S. Cl.
CPC ..... *B63H 11/08* (2013.01); *B63B 1/042* (2013.01); *B63H 2011/008* (2013.01); *B63H 2011/081* (2013.01)

(58) Field of Classification Search
CPC ..... B63H 11/00; B63H 11/08; B63H 25/00; B63H 25/46; B63H 2011/008;
(Continued)

(56) References Cited

U.S. PATENT DOCUMENTS 4,929,200 A * 5/1990 Guezou ..... B63H 11/00 440/38
5,090,929 A 2/1992 Rieben
(Continued)

FOREIGN PATENT DOCUMENTS

GB 1345517 A 1/1974
GB 2457019 A 8/2009

OTHER PUBLICATIONS

International Search Report, dated Feb. 25, 2019, from corresponding PCT application No. PCT/EP2018/082905.
(Continued)

*Primary Examiner* — Lars A Olson
(74) *Attorney, Agent, or Firm* — Nixon & Vanderhye

(57) ABSTRACT

Disclosed is a boat with at least one combustion engine positioned on or symmetrical with the vertical median plane of the boat and two engines provided symmetrical with respect to the vertical median plane, each including a propeller in a duct with: a central section on which the propeller is positioned, a rear section leading via a rear opening onto the transom of the hull, a front section with a continuous curved profile, leading via a side opening to the outside wall of the hull, the side opening having a larger cross-section than the cross-section of the rear opening in order for the duct to include at least one converging nozzle,
(Continued)

the front section being oriented so that the stream of water exiting from the side opening is directed towards the front and forms an angle of 20° to 60° with respect to the wall of the hull.

19 Claims, 9 Drawing Sheets

(58) Field of Classification Search
CPC ..... B63H 2011/081; B63B 1/00; B63B 1/04; B63B 1/042; B63B 11/107
USPC ..... 440/38, 40
See application file for complete search history.

(56) References Cited

U.S. PATENT DOCUMENTS

| | | | |
|---|---|---|---|
| 6,142,841 | A | 11/2000 | Alexander, Jr. et al. |
| 6,773,316 | B1 | 8/2004 | Keehn, Jr. |
| 2012/0291686 | A1 | 11/2012 | Loui et al. |

OTHER PUBLICATIONS

French Search Report, dated Jul. 19, 2018 from corresponding French application No. 1761344.

* cited by examiner

BOAT COMPRISING ENGINES THAT HAVE PROPELLERS EACH POSITIONED IN A DUCT, ENSURING OPTIMISED OPERATION DURING FORWARD TRAVEL AND HIGH MANOEUVRABILITY

This application relates to a boat that comprises drives that have propellers each positioned in a duct ensuring optimized operation when making headway and high maneuverability.

BACKGROUND OF THE INVENTION

The document FR-3,020,337 proposes a boat with hybrid propulsion that comprises a combustion drive and two electric drives placed on both sides of the combustion drive. Each electric drive comprises a propeller, positioned in a longitudinal duct, which extends from a water intake to a water outlet provided at the aft section of the boat. According to a special feature indicated in this document, each water intake is positioned in such a way as to be below the surface of the water when the boat sails at a speed below a given threshold and to be above the surface of the water when the boat lifts and sails at a speed in excess of the given threshold.

This embodiment is not completely satisfactory because it does not offer high maneuverability, in particular for carrying out certain maneuvers in port.

The document U.S. Pat. No. 5,090,929 proposes a boat equipped with two electric drives that are symmetrical relative to the median line of the hull and that each have a propeller positioned in a duct. Each duct comprises a first cylindrical and rectilinear section, which leads onto the transom of the boat and in which is positioned the propeller, as well as a second rectilinear section that leads, at a first end, onto the wall of the boat, and, at a second end, into the first section forward of the propeller. The second section leads onto the wall via louvered panels, oriented vertically, which orient the incoming stream of water in the direction of the propeller.

According to an embodiment, the boat comprises two drives at the bow for propelling the boat when making sternway and two drives at the aft section for propelling the boat when making headway.

According to this document, the electric drives are controlled by a single lever.

Even if this arrangement contributes to improving the maneuverability, the presence of four drives tends to complicate the boat design and therefore to increase its cost. According to another problem, the presence of the drives at the bow greatly tends to disrupt the flow of water along the hull when the boat is making headway and therefore to reduce the performance of the boat's propulsion system when making headway.

SUMMARY OF THE INVENTION

The purpose of this invention is to eliminate the drawbacks of the prior art.

For this purpose, the invention has as its object a boat that comprises at least one hull, a transom, at least two walls, as well as a propulsion system that comprises at least one internal combustion engine, positioned on or symmetrically relative to the vertical median plane of the boat, as well as at least two electric drives placed symmetrically relative to the vertical median plane and that each comprise a propeller placed in a duct that has:

- A central section on which the propeller is positioned,
- A rear section in the extension of the central section, which leads via at least one rear opening to the transom of the hull,
- A front section that leads via at least one side opening to a wall.

According to the invention, the duct has the following characteristics:

- The duct comprises at least one converging nozzle in the direction of a flow that passes from the side opening to the rear opening,
- The front section has a continuous curved profile, and
- The front section is oriented in such a way that the stream of water exiting from the side opening is directed in a direction oriented toward the bow and forms an angle of between 20 and 60° relative to the wall.

The fact that the duct comprises at least one converging nozzle in the direction of a flow that passes from the side opening to the rear opening makes it possible to optimize the performance for a movement forward. The fact that the stream exiting from the side opening forms an angle of between 20 and 60° relative to the wall makes it possible, when a single electric motor propels a stream of water toward the bow, to create a resulting force that effectively makes the boat rotate, and, when the electric motors simultaneously propel streams of water toward the bow, to move the boat back effectively. Finally, the fact that the front section has a continuous curved profile makes it possible to reduce the pressure drops and to optimize performance regardless of the direction of travel.

According to other characteristics of the invention, the duct has at least one of the following characteristics:

- The rear section comprises a converging nozzle such that the rear opening has a passage cross-section that is smaller than the passage cross-section of the central section,
- The front section comprises a converging nozzle such that the side opening has a passage cross-section that is larger than the passage cross-section of the central section,
- The rear section comprises an extension that projects relative to the transom,
- The propeller has a diameter that is greater than or equal to 150 mm, preferably on the order of 300 mm,
- At least one deflector configured to limit the intake of the stream of water into the duct when the boat is making headway at high speed.

BRIEF DESCRIPTION OF THE DRAWINGS

Other characteristics and advantages will emerge from the following description of the invention, a description provided only by way of example, with regard to the accompanying drawings, among which.

DETAILED DESCRIPTION OF THE PREFERRED EMBODIMENTS

Figure 1:
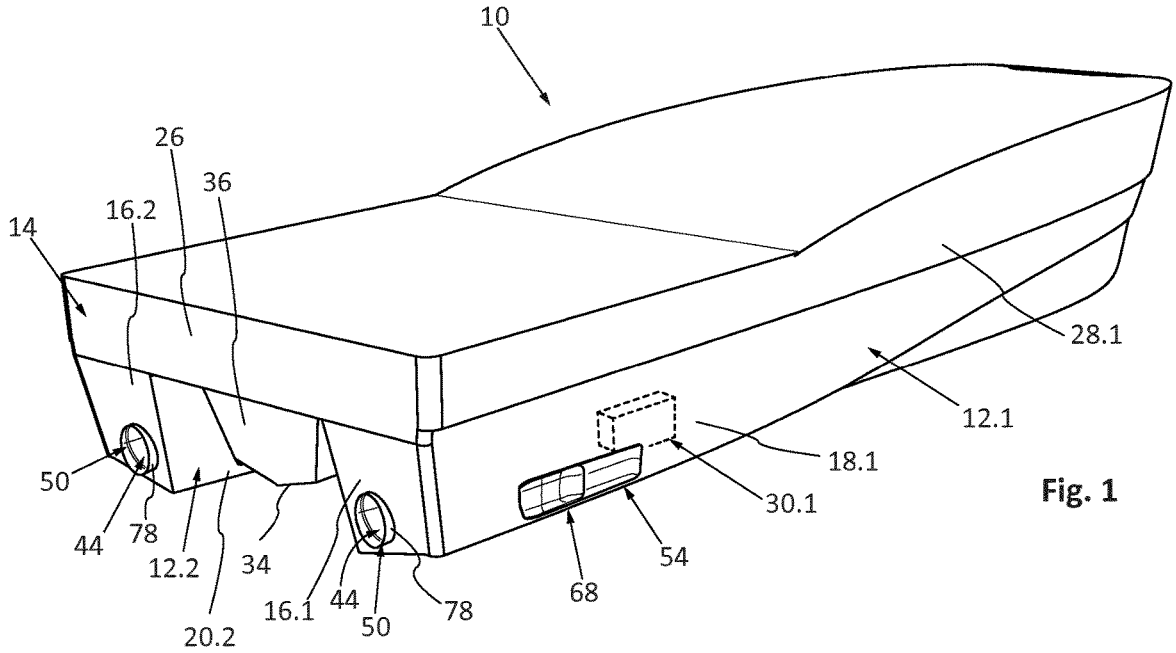
FIG. 1 is a perspective view, along a first angle of view, of a boat that illustrates an embodiment of the invention.
Figure 2:
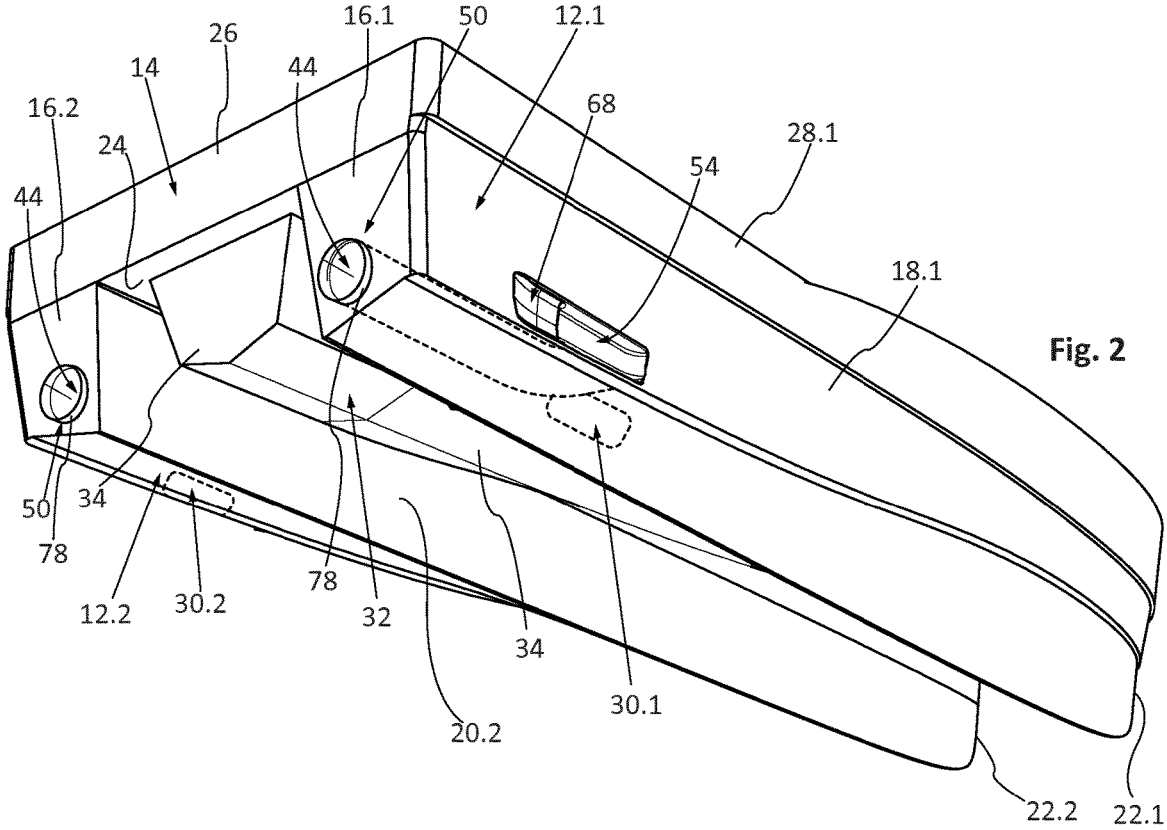
FIG. 2 is a perspective view, along a second angle of view, of the boat that is shown in FIG. 1.
Figure 3:
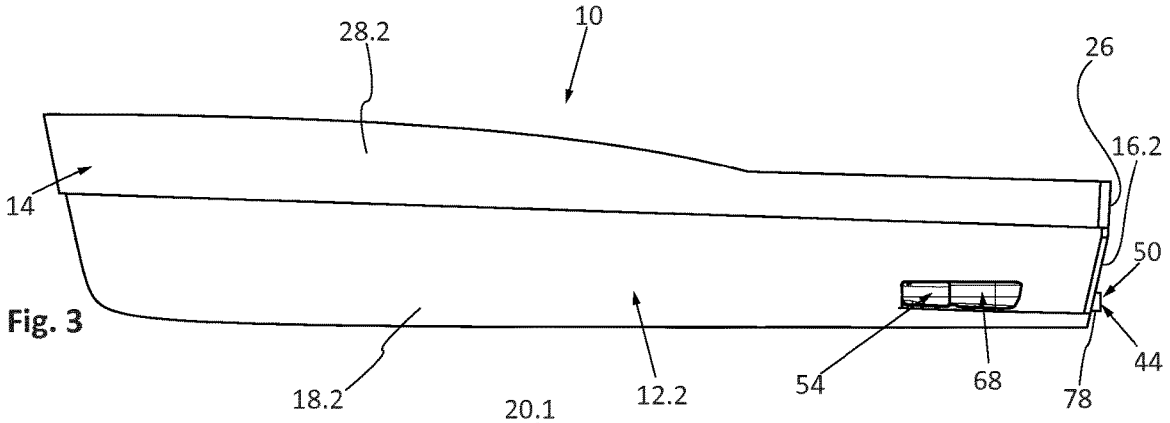
FIG. 3 is a side view of the boat that is shown in FIG. 1.

According to an embodiment provided by way of example that is non-limiting and shown in FIGS. 1 to 5, a catamaran-type boat comprises two hulls 12.1 and 12.2, respectively called first and second hulls below, connected by a platform 14.

Each hull 12.1 and 12.2 comprises a transom 16.1 and 16.2, an outside wall 18.1 and 18.2, and an inside wall 20.1 and 20.2 that meet at a forward point 22.1 and 22.2.

The platform 14 comprises a bottom 24 that extends between the two hulls, a transom 26 placed approximately in the same plane as the transoms 16.1 and 16.2 of the hulls, as well as sides 28.1 and 28.2 that respectively top the outside walls 18.1 and 18.2.

Figure 5:
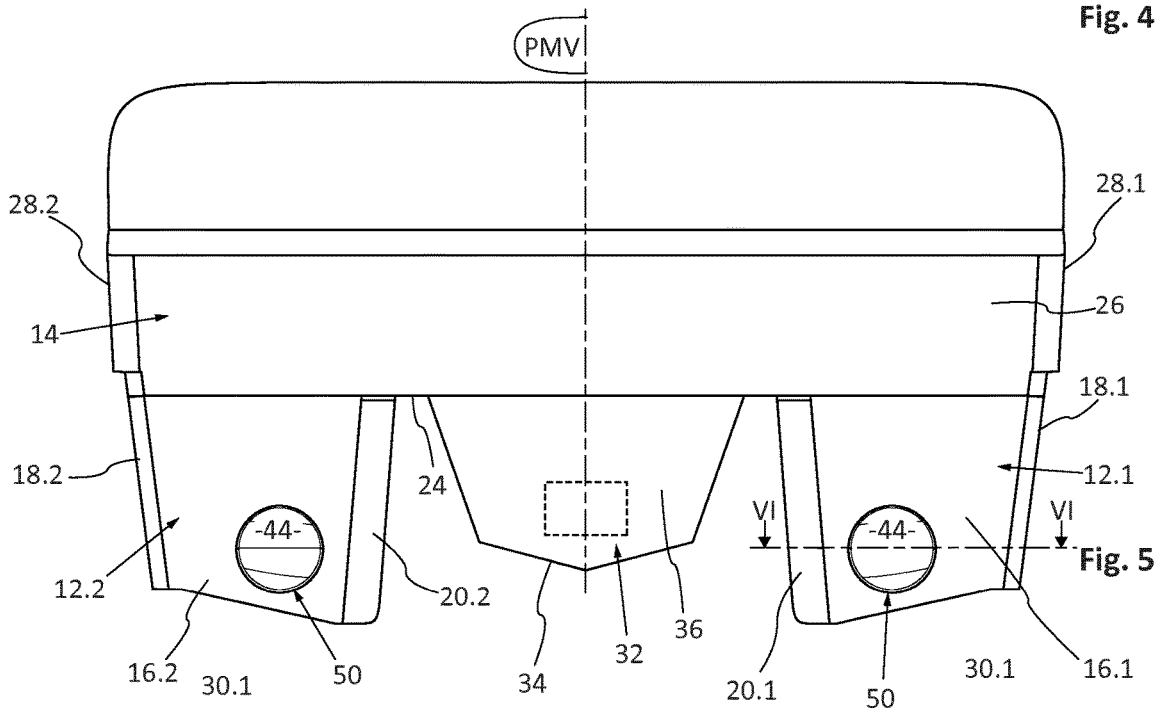
FIG. 5 is a rear view of the boat that is shown in FIG. 1.

The elements of the hull of the boat 10 are symmetrical relative to a vertical median plane PMV that is shown in FIG. 5. Hereinafter, a longitudinal direction is parallel to the median plane PMV and the horizontal. A transverse plane is perpendicular to the longitudinal direction.

The invention is not limited to catamarans. Regardless of the embodiment, the boat 10 comprises at least one symmetrical hull relative to the vertical median plane, at least one transom, and two outside walls that are approximately parallel to the longitudinal direction at the aft section of the boat.

Preferably, the boat 10 comprises at least two hulls 12.1, 12.2 that are tapered to obtain a deeper depression of the hulls 12.1, 12.2, as will be explained below.

The boat 10 comprises a waterline that corresponds to the intersection of the surface of the water and the hulls 12.1 and 12.2 when the boat is stopped or sails at a reduced speed, for example at a speed of less than 8 knots for a boat 9 m in length.

Hereinafter, for a hovercraft-type boat, high speed is defined as a speed higher than the minimum hydroplaning speed of the boat, and reduced speed is defined as a speed of less than the maximum hull speed of the boat.

The boat 10 comprises a propulsion system that comprises first and second electric drives 30.1 and 30.2, placed symmetrically relative to the vertical median plane PMV, and an internal combustion engine 32 positioned on the vertical median plane PMV or symmetrically relative to the latter.

As a complement to the electric drives, the boat 10 comprises batteries for storing electrical energy.

According to a first configuration, the internal combustion engine 32 is of the outboard type and is attached to the transom 26 of the platform 14.

According to another configuration that is shown in FIGS. 1 to 5, the internal combustion engine 32 is of the inboard type. In this case, it is positioned in part inside a central hull 34 positioned under the platform 14, projecting relative to the bottom 24, equidistant from the first and second hulls 12.1 and 12.2.

This internal combustion engine 32 comprises an output shaft configured to drive a propeller in rotation. According to an embodiment, the output shaft is connected to the propeller by a first linkage that comprises a vertical shaft making it possible to direct the propeller to starboard or to port, and a second linkage that comprises a horizontal shaft making it possible to immerse the propeller or to take it all the way or part of the way out of the water. According to an embodiment, the internal combustion engine 32 is of the "Z-drive" type.

As a variant, the output shaft of the internal combustion engine 32 is stationary, and the boat comprises a rudder.

The internal combustion engine 32 is not presented in more detail because it is known to one skilled in the art.

Figure 7:
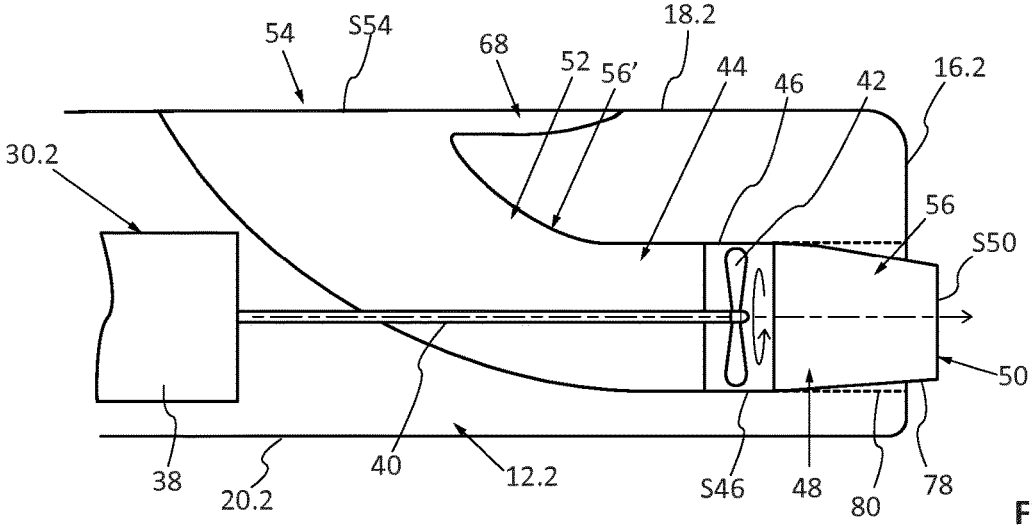
FIG. 7 is a cutaway, along the line VI-VI of FIG. 5, of a boat duct with a flow of the stream of water toward the aft section of the boat.
Figure 12:
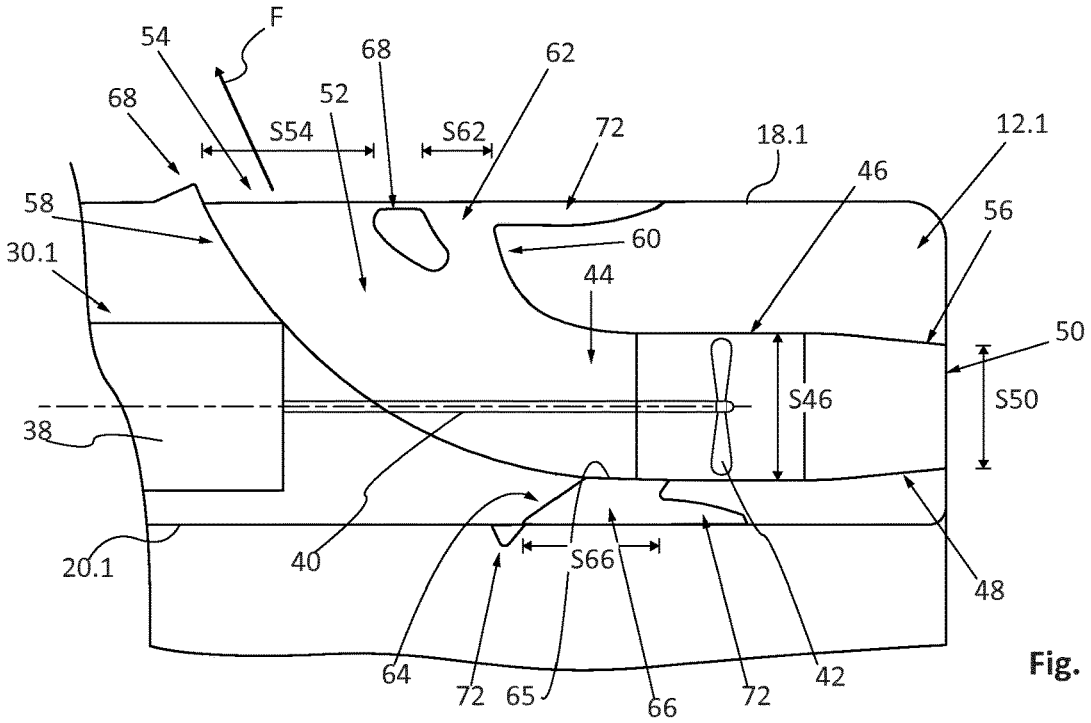
FIG. 12 is a cutaway of a boat duct that illustrates a second embodiment.

As illustrated in FIGS. 7 and 12, each first and second drive 30.1, 30.2 comprises an electric motor 38 operating in two directions, an output shaft 40 driven in rotation by the electric motor 38, and a propeller 42 attached to the output shaft 40.

Combined with the first and second drives 30.1 and 30.2, the boat 10 comprises two ducts 44 that are symmetrical relative to the vertical median plane PMV, a first duct 44 placed in the first hull 12.1 and a second duct 44 in the second hull 12.2 when the boat is a catamaran.

As illustrated in FIGS. 6 to 10 and 12 to 14, each duct 44 has:

- A central section 46, cylindrical (or non-cylindrical), on which the propeller 42 is positioned,
- A rear section 48, rectilinear, in the extension of the central section 46, which leads via at least one rear opening 50 to the transom 16.1 or 16.2 of the first or second hull 12.1, 12.2, and
- A front elbowed section 52 that leads via at least one side opening 54 to the outside wall 18.1 or 18.2.

According to a characteristic, each duct 44 has a length, starting from the transom 16.1, 16.2 of the boat, such that the side opening 54 is offset toward the aft section relative to the center of gravity of the boat. According to an embodiment, each duct 44 has a length, distance separating the side opening 54 from the transom 16.1, 16.2, of less than ¼ of the length of the boat (distance separating the bow and the stern of the boat). The length of the ducts 44 is to be the smallest possible to reduce the pressure drops and to increase the rotational torque when making sternway. By way of indication, for a boat of approximately 9 m, the side opening 54 is positioned at a small distance from the transom 16.1, 16.2, on the order of 1.3 m, less than 2 m.

Figure 4:
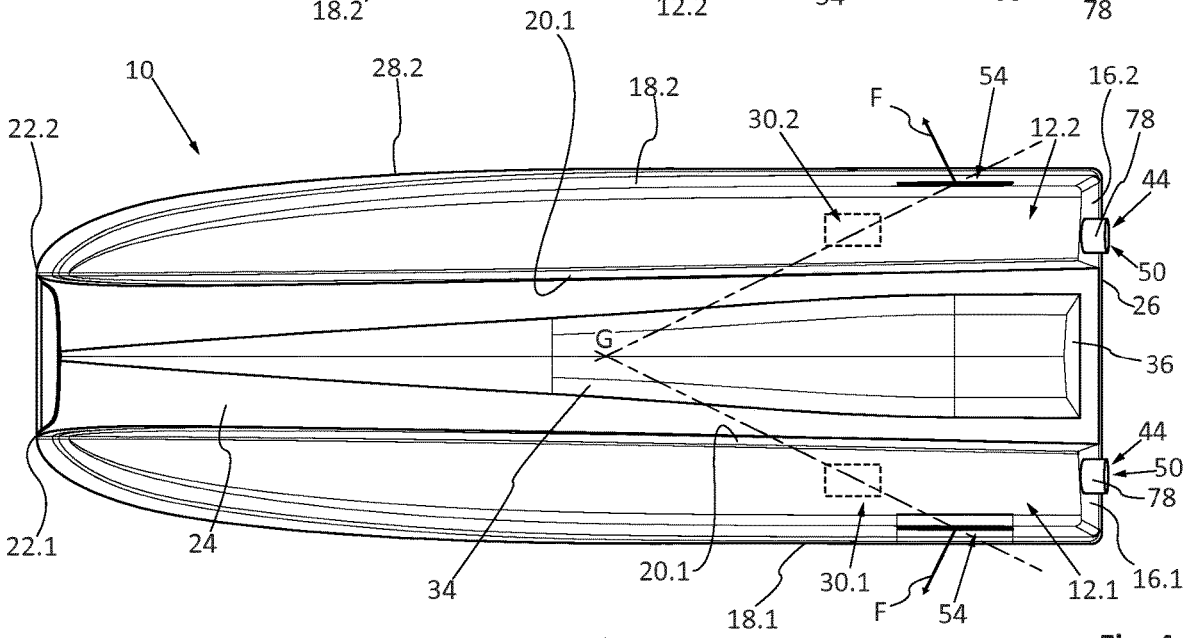
FIG. 4 is a bottom view of the boat that is shown in FIG. 1.

The front section 52 is oriented in such a way that the stream of water exiting from the side opening 54 is directed in a direction F forming an angle of between 20 and 60° relative to the outside wall 18.1 or 18.2 and oriented toward the bow. Thus, the direction F is essentially perpendicular to the line passing approximately through the center of the side opening 54 and the center of gravity of the boat G, as illustrated in FIG. 4. The fact that the side openings are as far apart as possible relative to the center of gravity of the boat G and that the direction F is essentially perpendicular to the line passing approximately through the center of the side opening 54 and the center of gravity of the boat G makes it possible to increase the rotational torque. This characteristic makes it possible to offer high maneuverability to the boat that can rotate in place.

According to a characteristic of the invention, the central section 46 has a diameter that is greater than or equal to 150 mm. The diameter of the central section 46 is proportional to the dimension of the boat. The propeller has a diameter that is very slightly smaller than that of the central section. The larger the diameter of the propeller, the higher the propulsion output. Moreover, the diameter should not be too large so that the side and rear openings are immersed during the operation of the two electric drives 30.1 and 30.2. For a 9 m boat, the propeller has a diameter that is greater than or equal to 150 mm, preferably on the order of 300 mm. This configuration makes it possible to produce a significant flow of water propelled by the propeller.

Each electric drive is preferably configured to operate in an optimal manner with a reduced rpm regime of the propeller, on the order of 1,500 rpm with ducts on the order of 300 mm in diameter and an approximately 9 m boat. This solution makes it possible to optimize the overall performance of the electric drives 30.1 and 30.2 that should operate at low pressure and high throughput.

According to another characteristic, the first and second drives 30.1 and 30.2 are configured to generate propulsion toward the bow when the propeller 42 rotates in a first direction of rotation and the water is ejected via the rear opening 50, or propulsion toward the aft section when the propeller 42 rotates in a second direction of rotation (opposite to the first direction) and the water is ejected via the main side opening 54.

To improve the performance of the propulsion system when making headway, the duct 44 comprises at least one converging nozzle in the direction of flow passing from the side opening 54 to the rear opening 50. This converging nozzle makes it possible to optimize the performance when the boat is making headway.

According to a configuration, the rear section 48 comprises a converging nozzle 56 in such a way that the rear opening 50 has a passage cross-section S50 that is smaller than the passage cross-section S46 of the central section 46. According to an embodiment, the converging nozzle 56 adjoins the rear opening 50. This position makes it possible to produce an acceleration of the stream of water at the outlet and therefore a reduction in pressure to a value that is close to the water pressure outside of the duct 44.

According to another configuration, the front section 52 comprises a converging nozzle 56', in the direction of flow passing from the side opening 54 to the rear opening 50, in such a way that the side opening 54 has a cross-section S54 that is larger than the passage cross-section S46 of the central section 46.

Figure 8:
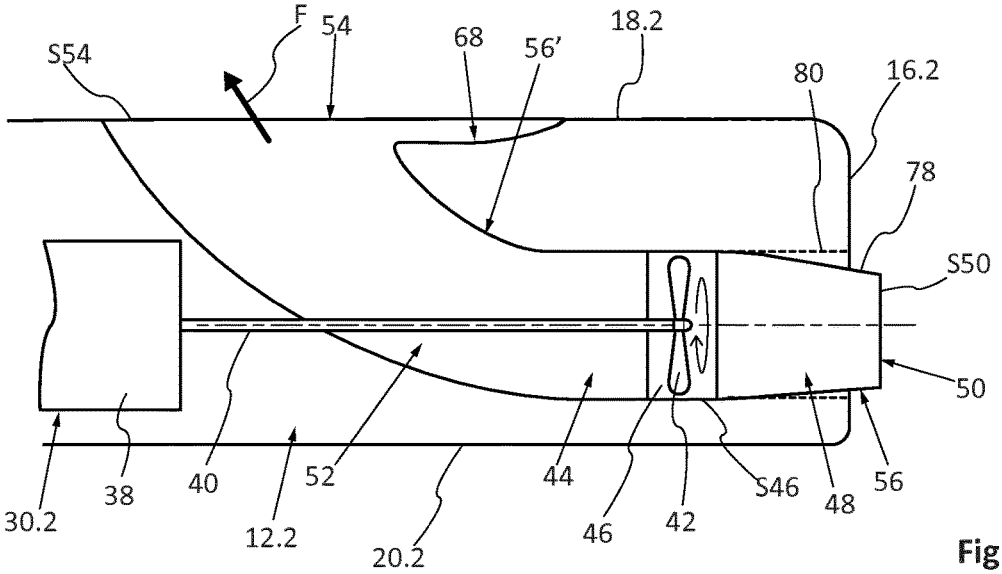
FIG. 8 is a cutaway, along the line VI-VI of FIG. 5, of a boat duct with a flow of the stream of water toward the bow of the boat.

According to a configuration that is shown in FIGS. 7 and 8, the duct 44 comprises two converging nozzles in the direction of flow passing from the side opening 54 to the rear opening 50, a first converging nozzle 56 between the central section 46 and the rear opening 50, and a second converging nozzle 56' between the side opening 54 and the central section 46. This double convergence makes it possible to achieve an acceleration of the stream of water downstream and upstream from the propeller 42.

According to a configuration, the side opening 54 has a cross-section S54 approximately whose surface is between 1.5 and 6 times the surface of the cross-section S50 of the outlet opening 50, ideally between 2 and 4 times the surface of the cross-section S50 of the outlet opening 50.

Figure 10:
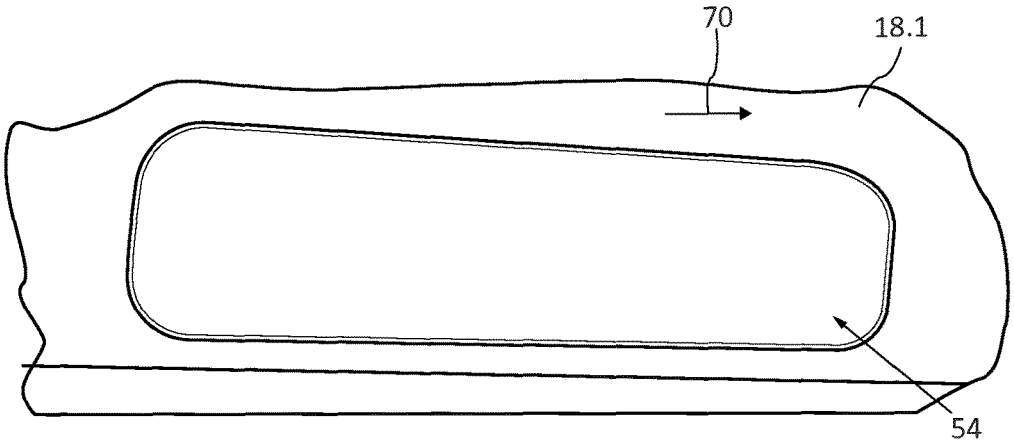
FIG. 10 is a front view of a side opening that illustrates another embodiment of the invention.
Figure 11:
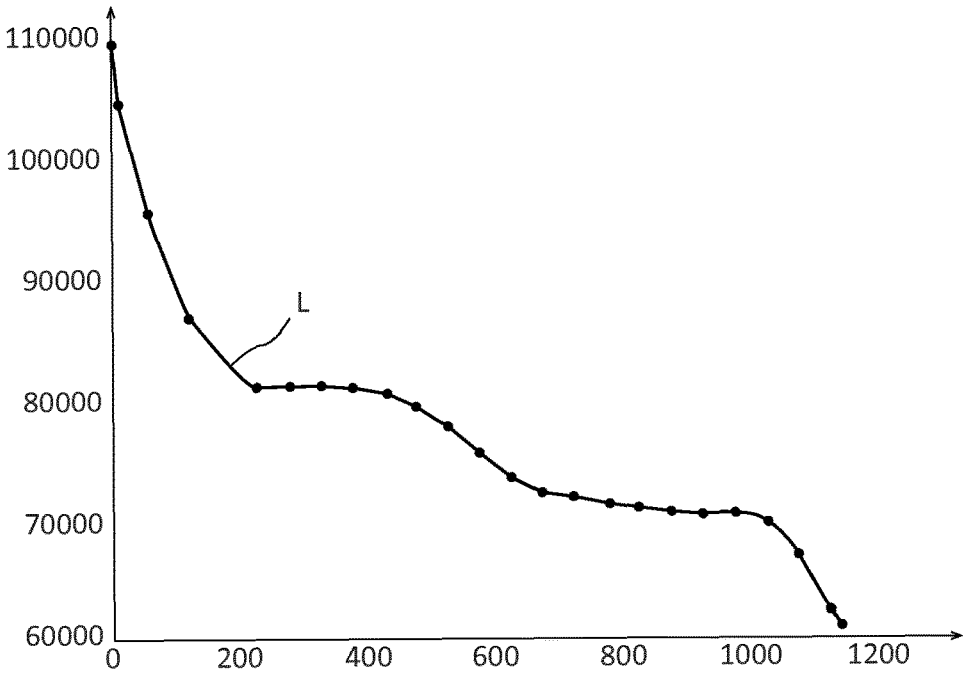
FIG. 11 is a diagram that shows the change in the cross-section of the duct of the side intake up to the transom for the embodiments that are shown in FIG. 10.

FIG. 11 shows, by way of indication, the change in the cross-section of the duct 44 based on the distance between the cross-section that is provided and the side opening 54, starting from the side opening 54 up to the transom. The curve L corresponds to the embodiment exhibiting the side opening 54 that is shown in FIG. 10.

Along the curve L, the duct 44 does not comprise any divergent portion.

According to a characteristic of the invention, the front section 52 has a continuous curved profile in the two directions of flow (from the side opening 54 to the rear opening 50 or from the rear opening 50 to the side opening 54). As illustrated in FIGS. 7 and 8, this continuous curved profile makes it possible to reduce the pressure drops and to achieve an orientation of the stream exiting from the side opening that is optimal for maneuverability.

Figure 9:
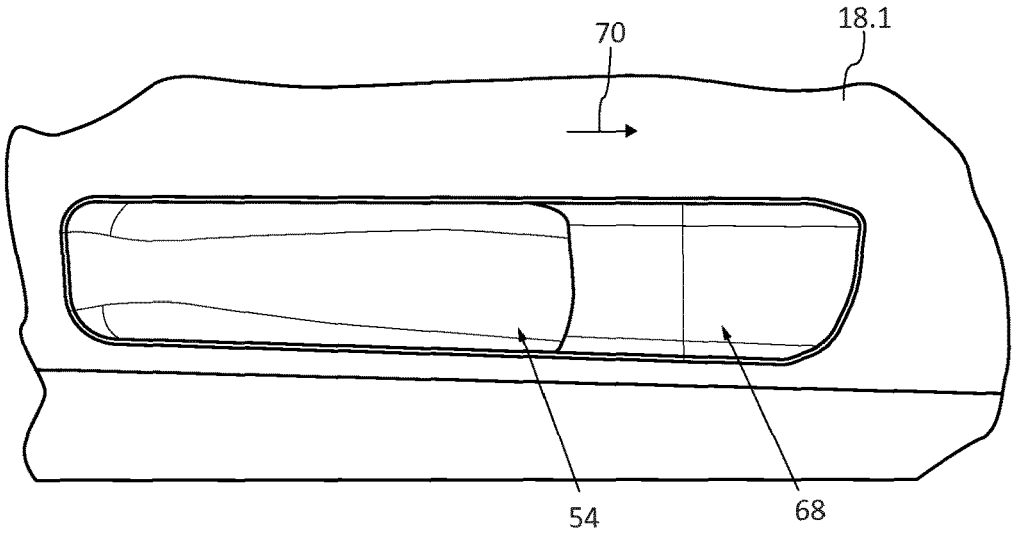
FIG. 9 is a front view of a side opening that illustrates an embodiment of the invention.
Figure 13:
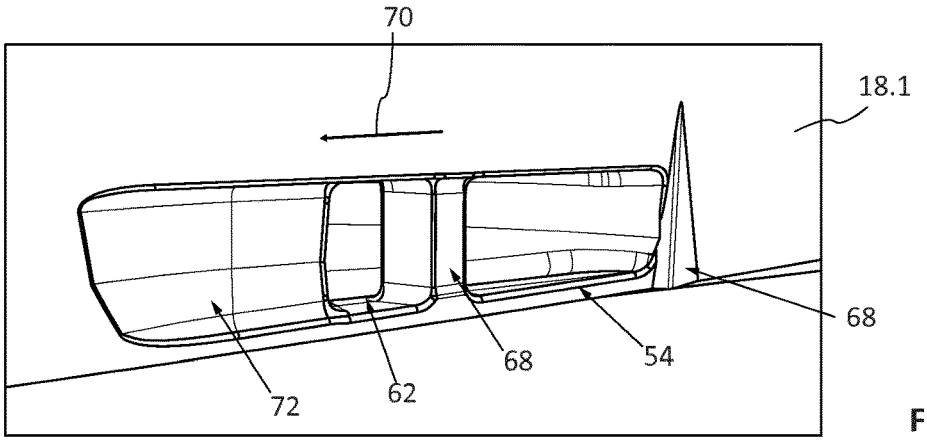
FIG. 13 is a perspective view of openings of the duct that is shown in FIG. 12 that lead onto an outside wall of the boat.

The side opening 54 has an approximately rectangular shape with a low height, less than 20 cm, and a great length, greater than 40 cm, as illustrated in FIGS. 9, 10, and 13. This configuration makes it possible to obtain a large cross-section while keeping the side opening 54 far away from the waterline when the drives 30.1, 30.2 are operating.

Figure 6:
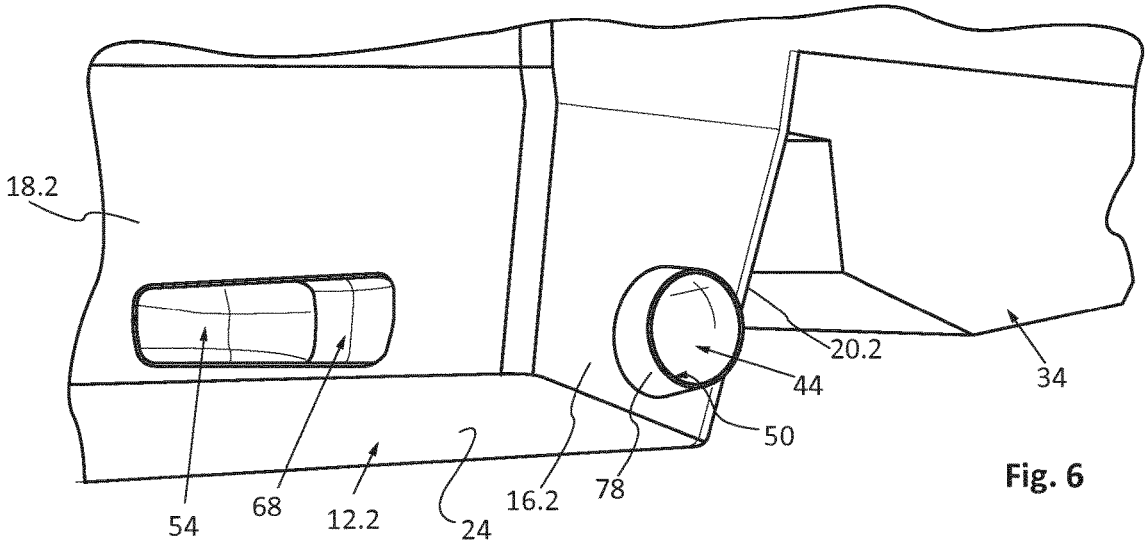
FIG. 6 is a perspective view of the aft section of a boat that illustrates a first embodiment.

According to another characteristic that is shown in FIGS. 6 to 8, the rear section 48 comprises an extension 78 that projects relative to the transom 16.1, 16.2. According to an embodiment, this extension 78 has a length—measured on the shaft of the duct 44 starting from the transom—that is greater than or equal to 10 cm. This solution makes it possible to keep the water from being released around the outlet opening 50 on the transom.

According to an embodiment that is shown in FIGS. 7 and 8, each transom 16.1, 16.2 has a removable part 80 that comprises the first converging nozzle 56 and the extension 78 (in the case of a variant that comprises an extension 78) to make it possible to access the propeller 42 and to be able to remove it.

According to a second embodiment, the front section 52 comprises a main side opening 54 and at least one secondary side opening. Thus, the duct 44 comprises at least one auxiliary section that leads, at a first end, into the central section 46 and/or the front section 52 forward of the propeller 42, and, at a second end, via a secondary side opening to an inside wall 18.1, 18.2 and/or outside wall 20.1, 20.2, offset toward the aft section relative to the main side opening 54.

Figure 14:
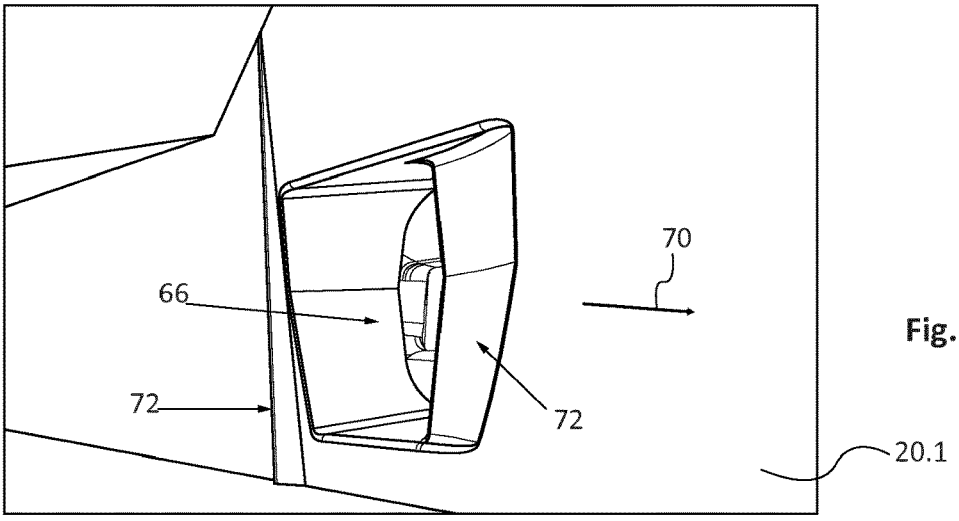
FIG. 14 is a perspective view of an opening of the duct that is shown in FIG. 12 that leads onto an inside wall of the boat.

The front duct 52 has a larger radius of curvature than that of the auxiliary section. According to an embodiment that is shown in FIGS. 12 to 14, the duct 44 comprises at least one outside auxiliary section 60 that leads, at a first end, into the central section 46 and/or the front section 52 forward of the propeller 42, and, at a second end, via an outside secondary side opening 62 to the outside wall 18.1 or 18.2, offset toward the aft section relative to the main side opening 54.

According to an embodiment, the duct 44 comprises at least one inside auxiliary section 64 that leads, at a first end 65, into the central section 46 and/or the front section 52 forward of the propeller 42, and, at a second end, via an inside secondary side opening 66 to the inside wall 20.1 and 20.2, offset toward the aft section relative to the outside side secondary opening 62.

According to an embodiment, the duct comprises at least one outside auxiliary section 60 and/or at least one inside auxiliary section 64.

In the presence of secondary side openings, the main side opening has a cross-section that is smaller than the passage cross-section of the main section 46. Thus, a converging nozzle 58 is obtained when the stream of water flows from the rear opening 50 to the side openings.

The sum of the cross-sections of the side openings 54, 62, 66 is greater than the cross-section S46 of the central section 46 that is itself greater than the cross-section S50 of the rear opening 50. Thus, at least one converging nozzle is obtained when the stream of water flows from the side openings to the rear opening 50.

When the propulsion system is making headway, at a reduced speed, the water penetrates the outside and inside secondary side openings 62 and 66 via the main side opening 54, is propelled by the propeller 42 toward the aft section, and exits via the rear opening 50.

When the propulsion system is making sternway, the water penetrates via the rear opening 50, is propelled by the propeller 42 toward the bow, and exits almost exclusively via the main side opening 54. Because of the continuity of the curvature of the front section 52 and/or because the front section 52 has a larger radius of curvature than that of the outside auxiliary section(s) 60 and the inside auxiliary section(s) 64, almost no water flows into the outside auxiliary section(s) 60 and the inside auxiliary section(s) 64.

According to another characteristic, the side openings 54, 62, 66 are designed in such a way as to reduce the perturbations at high speeds.

According to an embodiment that is shown in FIGS. 21 to 26, 27A to 27H, the body 130 comprises two hulls 12.1 and 12.2 that are symmetrical relative to the vertical median plane. These two hulls have a cross-section (perpendicular to the vertical median plane) that is tapered to obtain a depression of the hulls 12.1 and 12.2 ensuring an immersion of the ducts 44 when the boat advances at a low speed, for example in electrical operating mode.

Tapered is defined to mean that for each hull 12.1, 12.2, the ratio between a block coefficient and a prismatic coefficient $R=As/(Bwl \cdot T)$ is greater than 0.7, with As being the area of the largest immersed cross-section of the hull called amidships, Bwl being the width on the waterline of the amidships, and T being the height of the amidships.

According to another special feature, the amidships is positioned in a ⅓ aft section of the length of the boat.

According to another point, on the amidships, the minimal distance between the two hulls 12.1, 12.2 on the waterline is greater than or equal to half the width of the boat.

Figure 24:
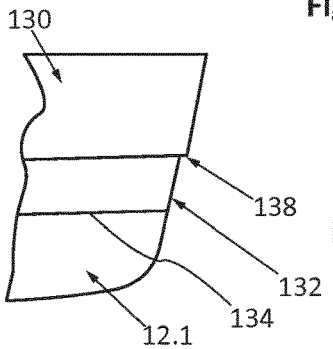
FIG. 24 is a side view of the bow of the hull that is shown in FIG. 21.

As illustrated in FIG. 24, each hull 12.1, 12.2 comprises an almost vertical bow 132 so as to maximize the waterline length.

For each hull 12.1, 12.2, the body 130 comprises an almost horizontal chine 134 (in a cross-section of the boat) with a dimension of approximately 50 mm. This chine 134 is positioned at mid-bow 132, and then is offset to be positioned on the bottom 136 of each hull.

Figure 25:
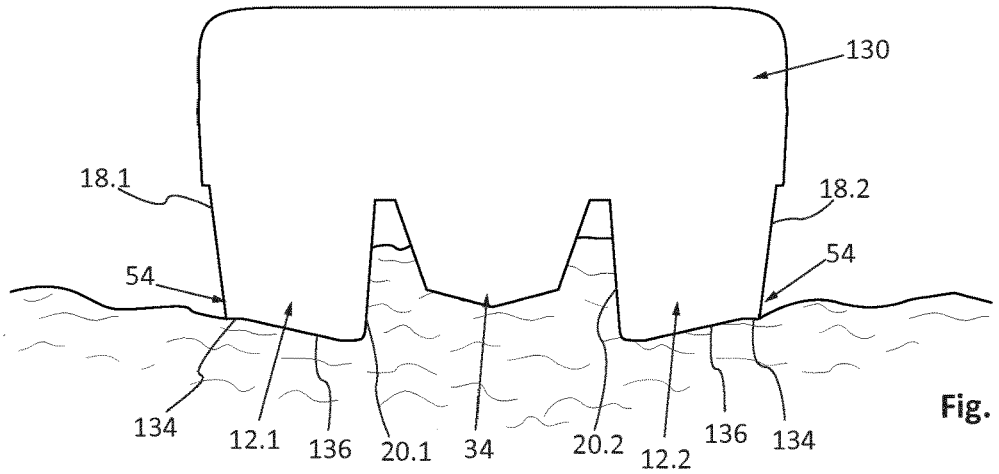
FIG. 25 is a transverse cutaway at the side openings of the visible hull 21 that illustrates the deflection of the water in thermal operating mode.

At the bow, the chine 134 is used as a deflector to channel the waves. On the aft section, as illustrated in FIG. 25, the chine 134 is used as a deflector and prevents the water from rising along the outside wall 18.1, 18.2 when the boat advances at high speed, in particular in thermal operating mode.

The bow 132 has a step 138 that projects relative to a surface that is smaller by approximately 50 mm, so as to channel the waves that go beyond the chine 134.

Figure 23:
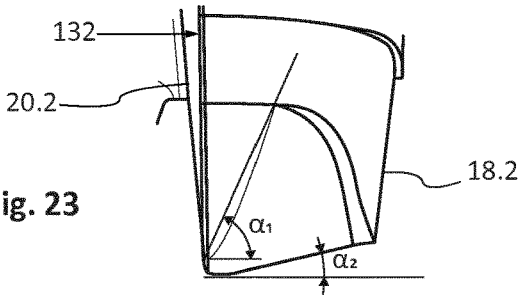
FIG. 23 is a longitudinal cutaway between the hulls of the bottom of the body that is shown in FIG. 21.

As illustrated in FIG. 23, the bottom 136 of each hull follows an evolving V, with the angle between the bottom 136 of the hull and the horizontal continuously changing all along the boat.

According to a special feature, the bottom 136 of each hull forms, at the bow of the boat, a first angle $\alpha 1$ with the horizontal of greater than 60°, preferably on the order of 75°, which makes it possible to have inputs of spray to reduce water penetration resistance.

The bottom 136 of each hull forms, on the transom, a second angle $\alpha 2$ with the horizontal of less than 20°, preferably on the order of 13°. This solution makes it possible to maximize the lift.

Figure 26:
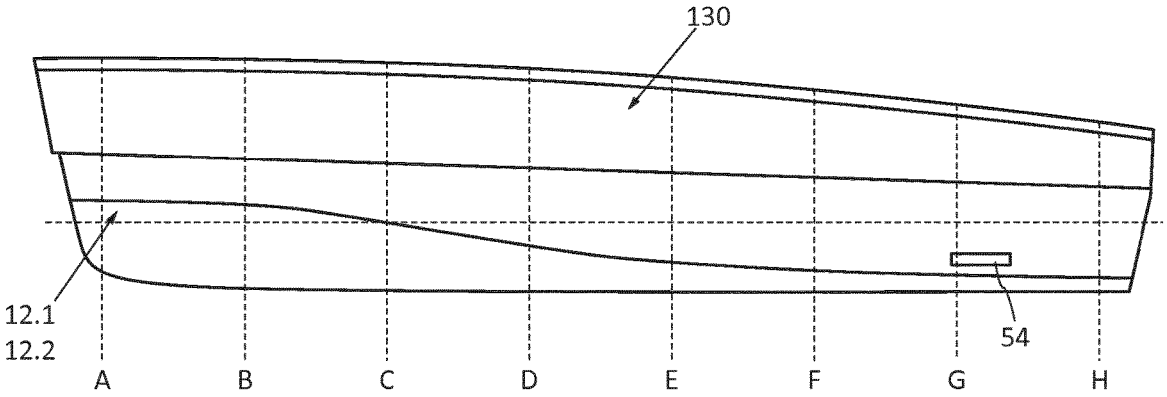
FIG. 26 is a side view of the hull of the boat that is shown in FIG. 21, and FIGS. 27A to 27H are cutaways of the hull respectively along transverse planes A to H of FIG. 26.
Figure 27A:
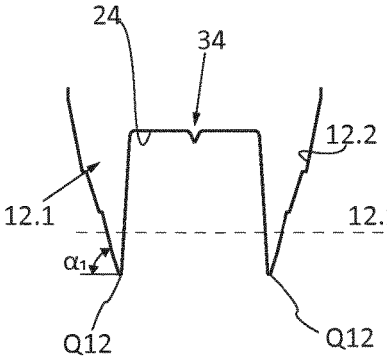
Figure 27B:
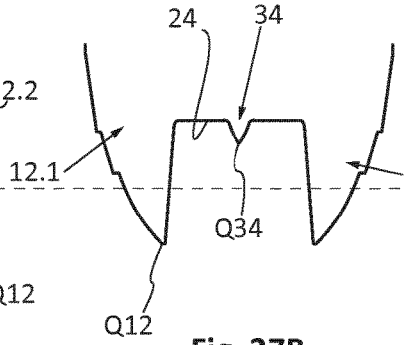
Figure 27C:
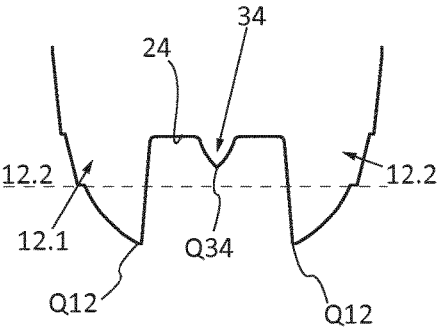
Figure 27D:
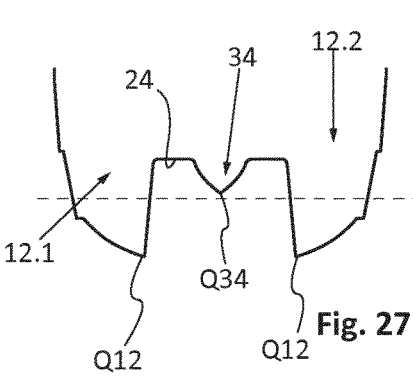
Figure 27E:
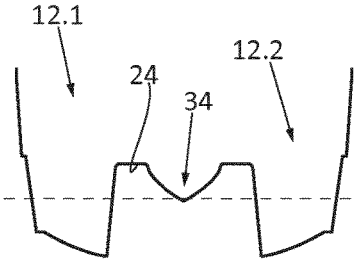
Figure 27F:
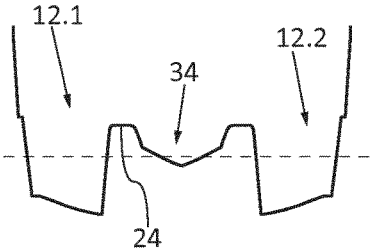
Figure 27G:
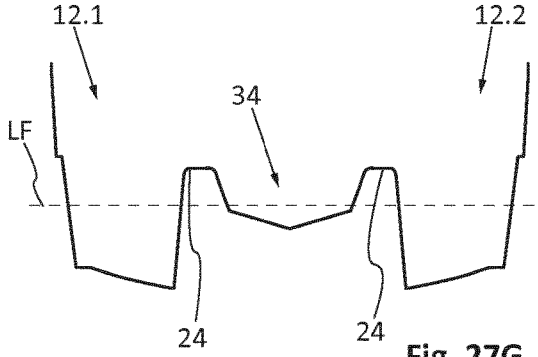
Figure 27H:
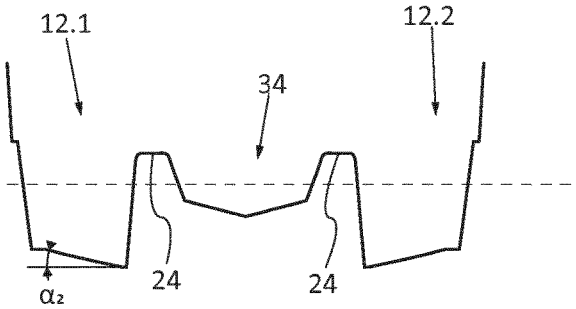

FIG. 26 shows a body 130 with multiple transverse cutaways A to H that are shown in FIGS. 27A to 27H.

The gap between the lines of the keel Q12 of the hulls 12.1, 12.2 gradually increases from the bow to the aft section. The keel line Q34 of the central hull 34 is always located above the line that passes through the keel lines Q12 of the hulls 12.1, 12.2 in the transverse planes. The passage cross-section of the water under the waterline at 3.5 t tends to increase from the bow to a cross-section that is located just forward of the side openings 54 and then decreases toward the stern.

According to an embodiment of the invention that is shown in FIGS. 9 and 13, each side opening 54 can comprise at least one deflector 68 that is configured to limit the intake of the stream of water 70 into the duct 44 when the boat is making headway at high speed and to avoid hindering the intake of water into the duct 44 when the boat operates at reduced speed.

According to an embodiment, the deflector 68 comprises a projecting shape relative to the outside wall 18.1 and 18.2 at the front of the main side opening 54, as illustrated by FIGS. 12 and 13, and/or a recess relative to the outside wall 18.1 and 18.2 at the rear of the main side opening 54, as illustrated in FIGS. 9 and 13.

According to an embodiment that is shown in FIGS. 12 to 14, each outside and/or inside secondary side opening 62, 66 can comprise a deflector 72, a projecting shape or a recess, configured to limit the intake of the stream of water 70 into the duct 44 when the boat makes headway at high speed with the internal combustion engine and to avoid hindering the intake of water into the duct 44 when the boat operates at reduced speed.

Figure 15:
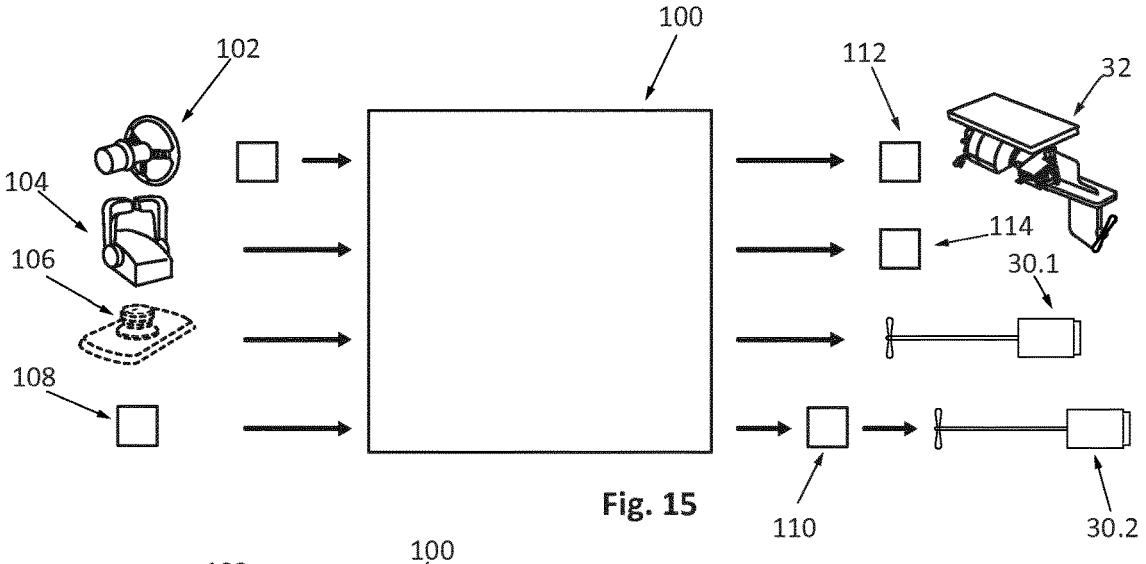
FIG. 15 is a diagram that illustrates the controls used to monitor the various drives of a boat in hybrid operating mode.

According to an embodiment illustrated in FIG. 15, the boat 10 comprises at least one master controller 100 whose inputs are connected to:

- A first heading control 102 configured to generate a heading command determined, for example, based on the angular position of a bar in the form of a steering wheel,
- A second acceleration control 104 configured to generate an acceleration command determined, for example, based on the angular position of a gas lever,
- A positioning sensor 108 of a cylinder (hydraulic or electric) that monitors the orientation of the base of the internal combustion engine 32 that supports the propeller.

According to another embodiment, in addition to the elements mentioned above, the boat 10 could comprise a third heading and/or acceleration control 106 configured to generate a heading and/or acceleration command determined, for example, based on the position of a "joystick"-type lever.

Figure 16:
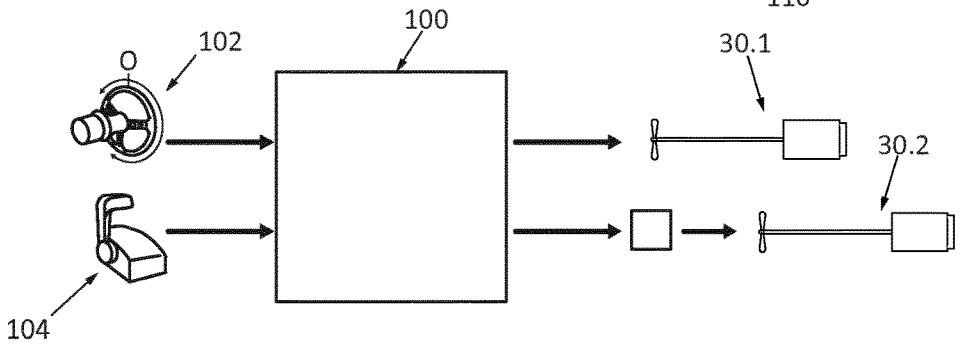
FIG. 16 is a diagram that illustrates the controls used to monitor the various drives in electrical operating mode.

The second control 104 can comprise a single lever, as illustrated in FIG. 16, or a double lever, one for each electric motor, as illustrated in FIG. 15.

The outputs of the master controller 100 are connected to one of the electric drives 30.1, to a slave controller 110 connected to another electric drive 30.2, to an actuator 112 configured to monitor the internal combustion engine 32, and to a proportional directional control valve 114 (in the case of a hydraulic cylinder) configured to monitor the position of the base of the internal combustion engine 32 that supports the propeller.

Figure 19:
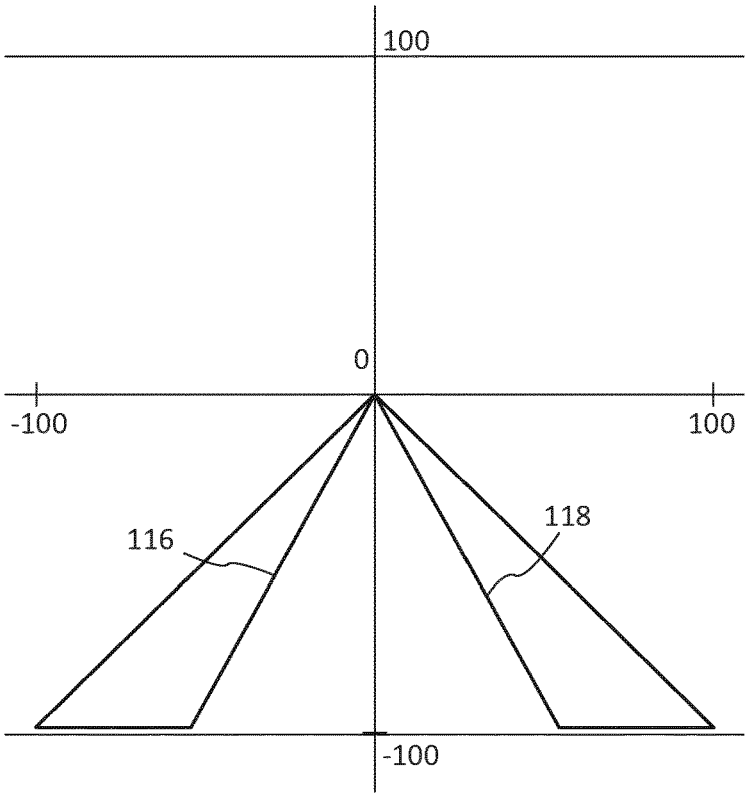
FIG. 19 is a diagram that illustrates the commands transmitted to the starboard and port drives based on the change in the heading command, in hybrid operating mode.

In hybrid operating mode, the master controller 100 can receive signals at these various inputs and can transmit signals via these various outputs. By way of example, FIG. 19 illustrates the commands transmitted to the electric drives 30.1 and 30.2, at reduced speed, based on the value of a heading command that varies from a minimal value to a maximal value, with the curve 116 corresponding to the values of the command transmitted to the electric drive 30.1 and the curve 118 corresponding to the values of the command transmitted to the electric drive 30.2. According to this FIG. 19, when the value of the command is less than 0, this corresponds to a direction of rotation of the electric drive that generates the propulsion of the stream of water toward the bow. At low speed, the steering of the electric motors makes it possible to enhance the maneuverability of the boat.

In electrical operating mode, as illustrated in FIG. 16, the master controller 100 can receive signals from the first heading control 102 and/or the second acceleration control 104 and emit signals in the direction of the first electric drive 30.1 and the slave controller 110 connected to the second drive 30.2.

Figure 17A:
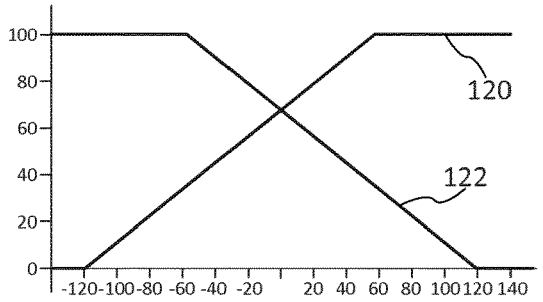
FIGS. 17A and 17B are diagrams that illustrate the commands transmitted to the starboard and port drives based on the change in the heading command, for the first and second constant values of the acceleration command, in electrical operating mode.
Figure 17B:
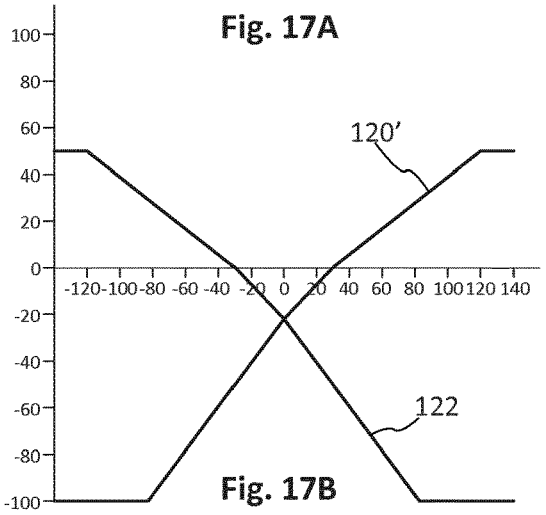

By way of example, FIGS. 17A and 17B illustrate the commands transmitted to the electric drives 30.1 and 30.2 based on the value of a heading command that varies from a minimal value to a maximal value, to produce a constant acceleration command value, with the latter having a first value in FIG. 17A and a second value in FIG. 17B. The curves 120 and 120' correspond to the values of the command transmitted to the first drive 30.1, and the curves 122 and 122' correspond to those transmitted to the second drive 30.2.

Figure 18:
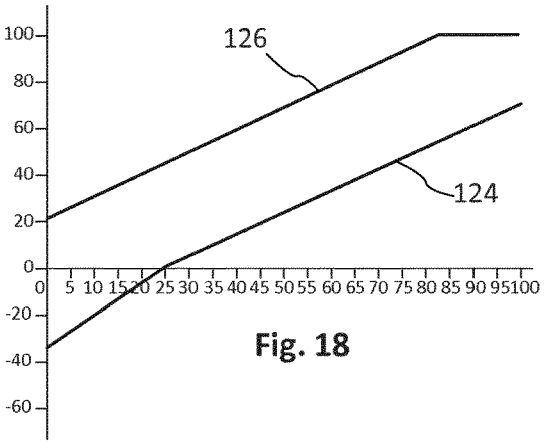
FIG. 18 is a diagram that illustrates the commands transmitted to the starboard and port drives based on the change in the acceleration command, for a constant value of the heading command, in electrical operating mode.

FIG. 18 shows the commands transmitted to the electric drives 30.1 and 30.2 based on the value of an acceleration command that varies from a minimal value to a maximal value, for a constant heading command value. The curve 124 corresponds to the value of the command transmitted to the first drive 30.1, and the curve 126 corresponds to the one transmitted to the second drive 30.2.

In electrical operating mode, the invention makes it possible—using only two electric drives 30.1 and 30.2, by modulating the rpm and the direction of rotation of the propellers 42 of the first and second drives 30.1 and 30.2 independently of one another—to move the boat forward, backward, to starboard, to port, or to rotate.

Figure 20A:
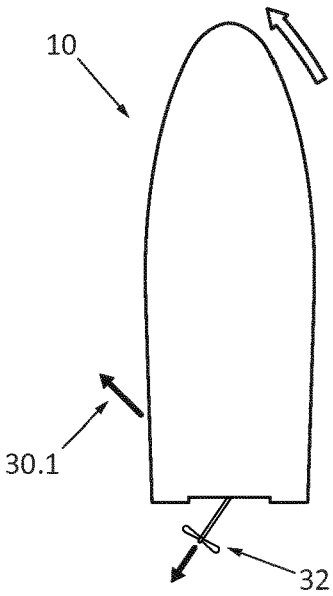
FIGS. 20A and 20B are top views of a boat that illustrate various examples of maneuvers.

As illustrated in FIG. 20A, when the internal combustion engine 32 is oriented to port and only the port electric drive 30.1 propels the water toward the bow, the boat 10 can turn to port.

Figure 20B:
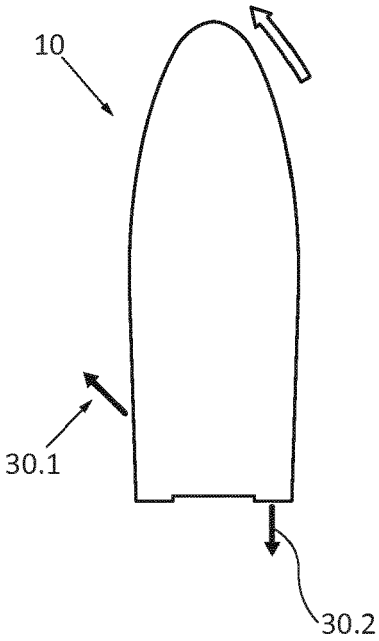
Figure 21:
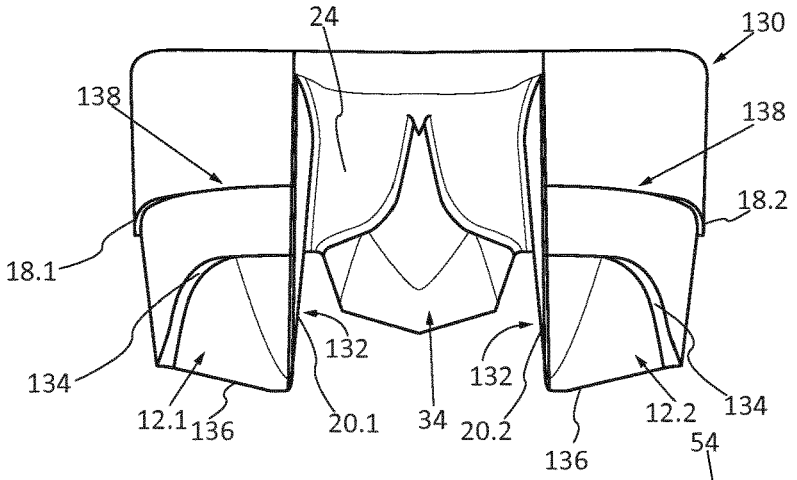
FIG. 21 is a view of a hull of a boat from the bow of the boat that illustrates an embodiment of the invention.
Figure 22:
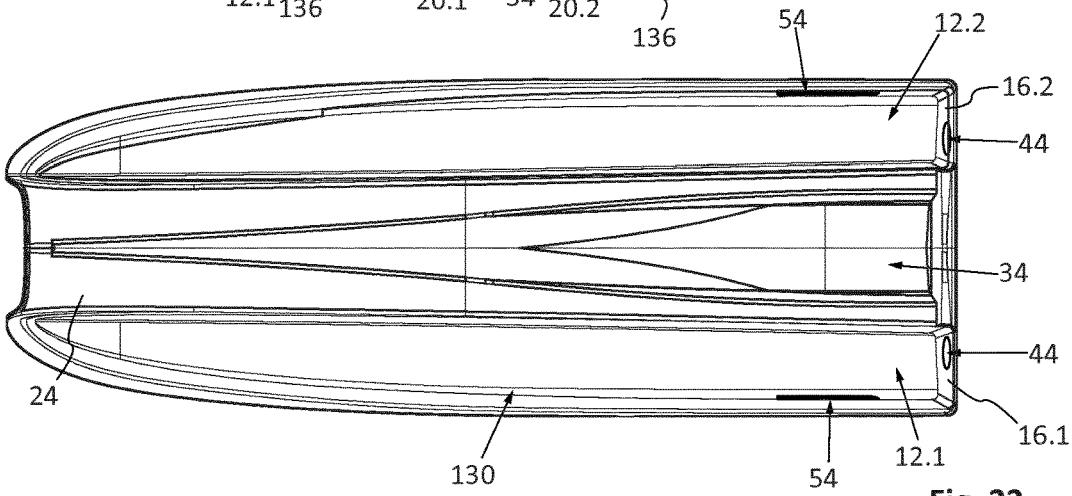
FIG. 22 is a bottom view of the hull that is shown in FIG. 21.

As illustrated in FIG. 20B, when the port electric drive 30.1 propels the water toward the bow and the starboard electric drive 30.2 propels water toward the stern, the boat 10 can—based on the modes—turn to port by advancing, standing still, or moving back.

In electrical mode, the steering of the boat can be done in two ways:

- Either by directing the boat with a steering wheel and controlling its speed with a lever, as described above,
- Or by directing the boat and controlling its speed with two levers, one for each electric motor.

The invention claimed is:

1. A boat, comprising:

a hull;

a transom;

at least two walls (18.1, 18.2); and a propulsion system that comprises at least one internal combustion engine (32) positioned on or symmetrically relative to a vertical median plane of the boat, and at least two electric drives (30.1, 30.2) placed symmetrically relative to the vertical median plane and that each comprise a propeller (42) placed in a duct (44), wherein each duct has:

a central section (46) at which the propeller (42) is positioned, a rear section (48) in an extension of the central section (46), which leads via at least one rear opening (50) to the transom, and a front section (52) that leads, via at least one side opening (54), to one of the two walls, the at least one side opening (54) having a cross-section that is larger than a cross-section of the rear opening (50) such that the duct (44) comprises at least one converging nozzle, and the front section (52) having a continuous curved profile, the front section (52) being oriented in such a way that a stream of water exiting from the side opening (54) is directed in a direction that is oriented toward a bow of the boat and forms an angle between 20° and 60° relative to said one of the two walls, and wherein for each said duct, the hull comprises a deflector (72) configured to limit intake of the stream of water (70) into the duct (44) when the boat is making headway at speed.

2. The boat according to claim 1, wherein the propeller (42) has a diameter that is greater than or equal to 150 mm.

3. The boat according to claim 1, wherein the side opening (54) has an approximately rectangular cross-section (S54) that has a surface of between two and four times a surface of the cross-section (S50) of the outlet opening (50).

4. The boat according to claim 1, wherein each duct (44) has a length of less than ¼ of a length of the boat.

5. The boat according to claim 1, wherein the rear section (48) comprises a converging nozzle, and wherein the front section (52) comprises a converging nozzle.

6. The boat according to claim 1, wherein the duct (44) does not comprise any divergence.

7. The boat according to claim 1, wherein the rear section (48) comprises an extension (78), projecting relative to the transom, which has a length, measured on a shaft of the duct (44) starting from the transom, that is greater than 10 cm.

8. The boat according to claim 7, wherein each transom has a removable part (80) that comprises a first converging nozzle (56).

9. The boat according to claim 1 comprising first and second hulls (12.1, 12.2), arranged symmetrically relative to a vertical median plane and connected by a platform (14) that has a bottom (24), each of the first and second hulls (12.1, 12.2) comprising a corresponding transom (16.1, 16.2), and constituting one of the at least two walls (18.1, 18.2) and an inside wall (20.1, 20.2), and each of the first and second hulls (12.1, 12.2) having a cross-section that is tapered to obtain a depression of the hulls and to ensure an immersion of the ducts (44) when the boat advances at speed.

10. The boat according to claim 9, further comprising:

a central hull (34), positioned under the platform (14), projecting relative to the bottom (24), equidistant from the first and second hulls (12.1, 12.2), with a keel line (Q34) of the central hull (34) always being located above the line that passes through the keel lines (Q12) of the first and second hulls (12.1, 12.2) in transverse planes.

11. The boat according to claim 9, wherein each of the first and second hulls comprises a ratio between a block coefficient and a prismatic coefficient R=As/(Bwl·T) that is greater than 0.7, with As being an amidships, Bwl being a width on the waterline of the amidships, and T being a height of the amidships.

12. The boat according to claim 9, wherein on an amidships, a minimal distance between the first and second hulls (12.1, 12.2) on the waterline is greater than or equal to half a width of the boat.

13. The boat according to claim 9, wherein for each of the first and second hulls, an amidships is positioned in a ⅓ aft section of a length of the boat.

14. The boat according to claim 9, wherein a bottom (136) of each of the first and second hulls (12.1, 12.2) forms a first angle ($\alpha$1) with a horizontal of greater than 60° on the bow of the boat.

15. The boat according to claim 14, wherein the bottom (136) of each of the first and second hulls (12.1, 12.2) forms, on the transom, a second angle ($\alpha$2) with a horizontal of less than 20°.

16. The boat according to claim 1, wherein for each of the first and second hulls, the side opening (54) has an approximately rectangular shape with a height less than 20 cm, and a length greater than 40 cm.

17. The boat according to claim 9, wherein each of the first and second hulls (12.1, 12.2) comprises a chine (134) with a dimension of approximately 50 mm, positioned at mid-bow (132), and then is offset on a bottom (136) of each hull.

18. The boat according to claim 9, wherein a bottom (136) of each hull (12.1, 12.2) forms a first angle ($\alpha$1) with a horizontal on the order of 75° on the bow of the boat.

19. The boat according to claim 1, wherein the propeller (42) has a diameter on the order of 300 mm.

* * * * *